United States Patent [19]

Winkler

[11] 3,997,791

[45] Dec. 14, 1976

[54] X-RAY DIAGNOSING DEVICE FOR PRODUCING X-RAY PHOTOGRAPHIC SERIES

[75] Inventor: Hans-Werner Winkler, Buckenhof, Germany

[73] Assignee: Siemens Aktiengesellschaft, Munich, Germany

[22] Filed: Jan. 11, 1974

[21] Appl. No.: 432,671

[30] Foreign Application Priority Data

Jan. 19, 1973 Germany ..... 2302691

[52] U.S. Cl. ..... 250/416 R; 250/414

[51] Int. Cl.[2] ..... H05G 1/30

[58] Field of Search ..... 250/416, 420, 414, 415

[56] References Cited

UNITED STATES PATENTS

| | | | |
|---|---|---|---|
| 2,785,343 | 3/1957 | Wright et al. | 250/415 |
| 3,094,618 | 6/1963 | McLaughlin | 250/416 |
| 3,243,591 | 3/1966 | Lesnick et al. | 250/415 |
| 3,290,596 | 12/1966 | Boughe | 250/416 |
| 3,459,941 | 8/1969 | Redzinski et al. | 250/416 |
| 3,492,483 | 1/1970 | Branelik et al. | 250/416 |
| 3,746,862 | 7/1973 | Lombardo et al. | 250/416 |

*Primary Examiner*—Alfred E. Smith
*Assistant Examiner*—B. C. Anderson
*Attorney, Agent, or Firm*—V. Alexander Scher

[57] ABSTRACT

An X-ray diagnosing device for producing X-ray photographic series, particularly motion pictures, has means for overload protection of the X-ray tube and an indicating device for the permissible scene duration. The invention is particularly characterized by a calculator which is programmed corresponding to anticipated photographing programs, and which produces upon the indicating device the duration of a scene, and indication zero for the pause required for the full scene duration after the last photographing series corresponding to the selected photographing program, and, after the termination of this pause, an indication of the full scene duration.

5 Claims, 2 Drawing Figures

X-RAY DIAGNOSING DEVICE FOR PRODUCING X-RAY PHOTOGRAPHIC SERIES

This invention relates to an X-ray diagnosing device for making X-ray photographic series, particularly, motion pictures, having means protecting the X-ray tube from overload and an indicating device for the permissible scene duration.

An X-ray diagnosing device is known, which is used for making photographing series, and which is provided with a device causing the switching off of the X-ray tube when a time limit has been reached which is permissible for the maximum load. However, in most cases, the X-ray diagnosing device is not operated with a maximum load, so that the duration of a scene could be longer than this time limit. The load capacity of the X-ray tube is thus fully utilized only in very rare cases. Furthermore, in this known X-ray diagnosing device, it is possible, after the termination of a photographing series, to switch on again the X-ray tube at any time for the making of a new photographing series without giving the user any information about the time which has passed after the end of the last photographing series and thus the extent of cooling of the X-ray tube. Therefore, an overload cannot always be avoided.

In an earlier patent application of the same applicant, it was suggested that these drawbacks could be avoided by the provision of an indicating device which always indicates the greatest permissible scene duration when considering the cooling of the X-ray tube. This earlier suggestion makes it possible to provide the servicing operator with precise information about load conditions for simple servicing, but the construction is very complicated and expensive, and requires a comparatively large switching technical arrangement.

An object of the present invention is to provide an X-ray diagnosing device of the above-described type, wherein an overload of the X-ray tube is eliminated with safety, and wherein are taken into consideration the cooling of the X-ray tube occurring after the ending of the last photographing series, as well as the set load of the X-ray tube. The technical switch connected should be smaller than that of the earlier suggestion.

Other objects of the present invention will become apparent in the course of the following specification.

In the accomplishment of the objectives of the present invention, it was found desirable to provide a calculator which is programmed corresponding to anticipated photographing programs, and which produces, upon an indicating device, the duration of a scene, an indication zero for the pause required for a full scene duration after the last photographing series corresponding to the selected photographing program, and, after the termination of this pause, an indication of the full scene duration.

Thus, according to the present invention, an overload of the X-ray tube is eliminated with safety, in that the user does not begin a photographing series during the indication zero. It is always possible to determine upon the indication device when the maximum scene duration provided for the selected photographing program can be carried out. Thus, the servicing of the X-ray diagnosing device is very simple. Furthermore, it is possible, in particularly important cases, to start a photographing series during the indication zero, although then, the possibility of an overload of the X-ray tube must be taken into consideration.

The invention will appear more clearly from the following detailed description when taken in connection with the accompanying drawings showing, by way of example only, a preferred embodiment of the present idea.

Figure 1:
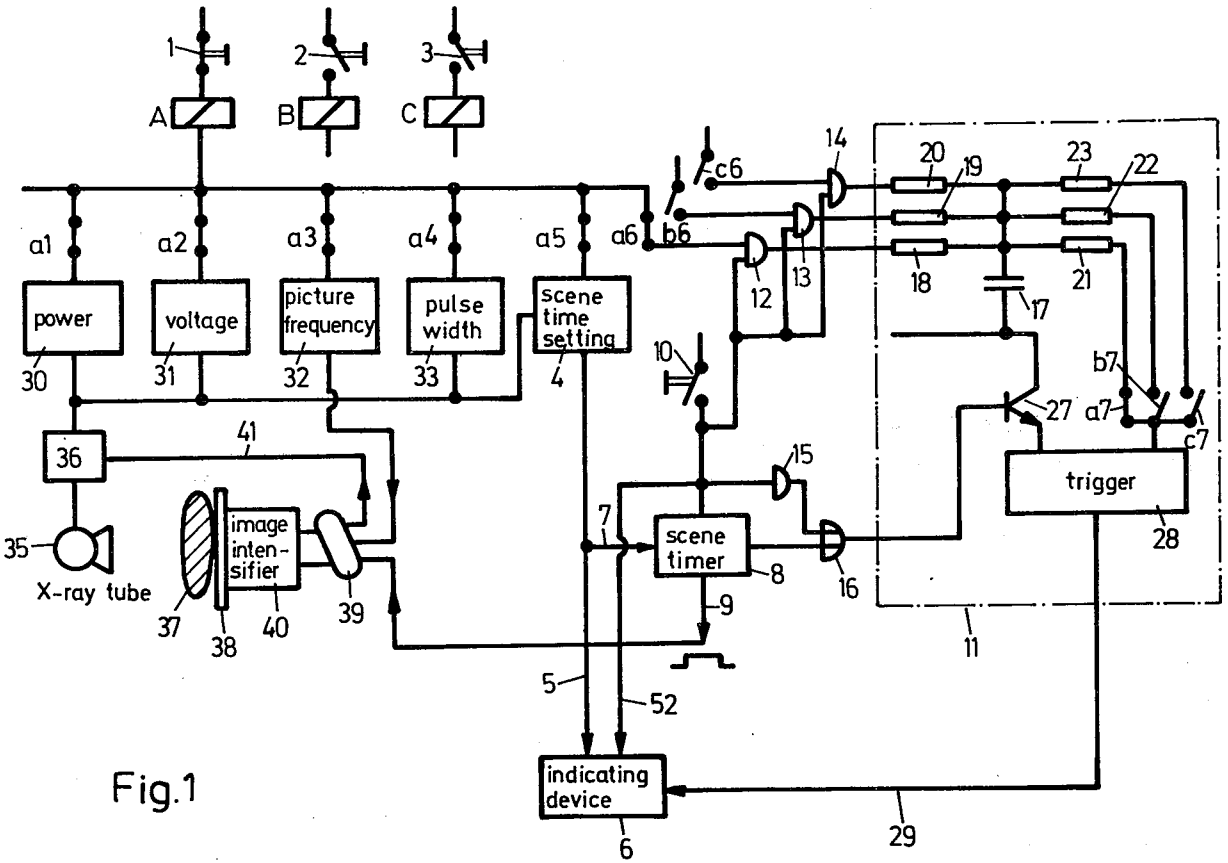
FIG. 1 is a switch circuit of an X-ray diagnosing device of the present invention.

The X-ray diagnosing device shown in FIG. 1 makes possible the setting of photographing data by means of functional keys, so that the individual photographing programs can be set by pressing a single key. By way of example, the drawing shows three functional keys 1 to 3. The functional key 1 is shown as being pressed while the keys 2 and 3 are open. The key 1 is connected with a relay A, which has contacts *a*1 to *a*7. The contacts are held closed, since the key 1 is pressed. The relays B and C have corresponding contacts which are operated by keys 2 and 3. Of these contacts, the drawing shows only contacts *b*6 to *b*9 as well as contacts *c*6 to *c*9.

The contacts *a*1 to *a*5 operate the means for setting the X-ray tube load (*k*W), the X-ray tube voltage (*k*V), the image frequency (B/*s*), the pulse width (*ns*) and the scene time (*ts*). Means for scene time setting are indicated with the numeral 4 in the drawing. They produce an outgoing signal, which is conducted through a conduit 5 to a scene time indicating device 6. This outgoing signal also operates through a conduit 7 and a scene timer 8. The scene timer switch 8 produces, after the termination of the scene time *ts* corresponding to the pressed key, the ending of the scene by a signal at its outlet 9. The starting of the scene takes place by actuating a key 10.

A calculator 11 serves to operate the scene time indicating device 6. The calculator is actuated by the key 10 and contacts *a*6 to *c*6 through three AND gates 12 to 14 and also by the key 10 and scene timer 8, through a reverse stage 15 and an OR gate 16. The calculator 11 contains a capacitor 17 which is chargeable by three different resistances 18 to 20, and is dischargeable by three different resistances 21 to 23. The calculator 11 is programmed by resistances 18 to 23 corresponding to the photographing programs. A transistor 27 is used to operate the discharge of the capacitor 17. The discharge voltage of the capacitor 17 is transmitted to a tipping member or trigger 28, which operates the scene time indicating device 6 through a conduit 29.

The illustrated X-ray diagnosing device is shown in the condition prior to the start of a photographing scene. The photographing data have been set while the key 10 has not been pressed as yet. In the scene time indicating device 6, the complete scene time is indicated, so that this scene duration is available at all times. When a scene is started, namely, when the key 10 is closed, a conduit 2 transmits a discharge signal to the scene time indicating device 6, which produces an indication zero upon the indicating device 6. The starting of the scene actually takes place by a signal transmitted through the key 10 to the scene timer switch 8. The scene timer 8 causes the ending of the photographing scene after the termination of the programmed scene time *ts*.

The charging of the capacitor 17 in the calculator 11 takes place during a photographic scene through the resistance 18 which is operated through the UND gate 12 and the closed contact *a*6 as well as the key 10. The resistance 18 has a measurement corresponding to the heating of the anode of the X-ray tube for the selected photographing program; namely, the condenser voltage at the capacitor 17 increases corresponding to this heating. After the termination of the scene by the scene timer switch 8, or by opening the key 10 prior to the termination of the scene time *ts*, the transistor 27 is switched over through the OR gate 16, which is operated by the key 10 through the reversing stage 15. It causes a discharge of the capacitor 17 through the resistance 21, since the contact *a*7 is closed. The resistance 21 causes the cooling of the anode of the X-ray tube, since the voltage at the inlet of the tipping trigger 28 runs corresponding to the cooling of the X-ray tube. When a specific value is reached, the tipping trigger 28 causes through the conduit 29 that a full scene time period will again be indicated at the scene time indicating device 6. Thus, this voltage is so measured that when it is reached, the temperature of the anode of the X-ray tube is lowered to such an extent that a full scene time period is available.

When a photographing scene is terminated prior to the ending of scene time *ts* through the opening of the key 10, the voltage at the capacitor 17 will not reach its maximum value. Correspondingly, that voltage at which the tipping trigger 28 will show the full scene time at the discharge of the capacitor 17 will be reached earlier than would have been the case if the full scene time period was used.

A resistance for the charging of the capacitor 17 and a resistance for its discharge are provided for each of the anticipated photographing programs. These resistances can be selected by corresponding contacts, of which contacts *a*6 to *c*6, as well as *a*7 to *c*7, have been shown in the drawing. In this manner, it can be individually determined when, for each photographing program, the full scene duration has been shown again in the scene time indicating device 6. This indication can take place corresponding to the heating or cooling of the anode of the X-ray tube. The term "scene time", which is the same as "scene duration", means the duration of a photographing scene, namely, a film scene produced by the film camera 39. Thus, scene duration is the time period during which the film camera 39 is uninterruptedly switched on for the taking of a film scene.

The overload-indicating device of the present invention consists of the calculator 11 along with the indicating device 6. When the X-ray tube 35 is not switched on, the overload of the X-ray tube is safely prevented as long as the indicating device shows the scene time indicated as zero. The calculator 11 actuates the indicating device 6 in such manner that the indicating device, after the termination of a photographing scene, will show the time zero, whereby the X-ray tube cannot be switched on without overload for starting a new scene with the set scene duration. The user must, therefore, wait until the indicator upon the indicating device 6 moves from zero to the set value. As soon as the set value is indicated, the user can start a new scene without overloading the X-ray tube. In order to operate the indicating device 6, the calculator has various resistances 18 to 23, by means of which different programs are provided corresponding to different photographing programs and thus to different scene time periods. The resistances are automatically selected when a specific scene time is selected. The selected program causes the actuation of the indicating device 6.

The operation of the X-ray diagnosing device of the present invention will now be described as follows:

After the selection of the desired photographing program, particularly after the selection of the desired scene duration, the indicating device 6 will show this scene time period. When the scene is started, this indicator will jump to zero, and will keep this indication after the ending of the scene for so long until the full scene time period of the selected photographing program can be started again. At that moment, the indicator jumps back to the full scene duration. The pause between the ending of a scene and the moment when the full scene duration is again shown upon the indicating device 6 depends upon how long the previous scene has actually continued. Independently from the indication, a start of a new scene can take place at any time when a danger of the overload of the X-ray tube is accepted, if this appears necessary for medical reasons. An overloading of the X-ray tube is positively eliminated when no scene is started, when the indicating device shows zero.

The drawing shows the contacts *a*1 to *a*5 as set for photographing data. Similarly, the relays B and C have contacts for setting photographing data pertaining to them, and thus for the functional keys 2 and 3.

In accordance with the present invention, the functional keys for setting photographing data can be eliminated if the operational simplicity provided by these keys is to be eliminated. In that case, an individual setting of the desired scene time duration *ts* will take place. In that case, the functioning of the X-ray diagnosing device of the present invention is the same as when functional keys are used. The full scene duration is always shown when it is available. The pause between the termination of one scene and the indication of the full scene duration is diminished relatively to the full carrying out of the selected scene duration when the selected scene duration *ts* is not fully used out. The scene durations of the individual photographing programs are so measured that the X-ray tube will not be overloaded if they are indicated by the indicating device 6 and are fully used up.

The setting means of the X-ray tube power, the X-ray tube voltage, the picture frequency and the pulse width of the X-ray impluses are indicated by numerals 30 to 33 in FIG. 1. FIG. 1 shows that the setting means 30, 31 and 33, as well as 4, are connected to an X-ray generator 36 feeding and operating an X-ray tube 35. The setting of the X-ray generator is thus carried out in the known manner. FIG. 1 also shows diagrammatically in cross-section the patient 37 lying upon a support 38. An X-ray image intensifier 40 is connected in front of the film camera 39. The film camera 39 is operated, on the one hand, by the setting means 32 for the picture frequency, and on the other hand, by the outgoing signal of the scene timer 8. The film camera 39 operates, through the conduit 41, the X-ray generator 36, so that the X-ray tube 35 produces an X-ray impulse in synchronism with the film movement whenever a picture stands still. The scene timer 8 emits, at the end of each scene, a signal at its outlet 9 which stops the camera 39.

Figure 2:
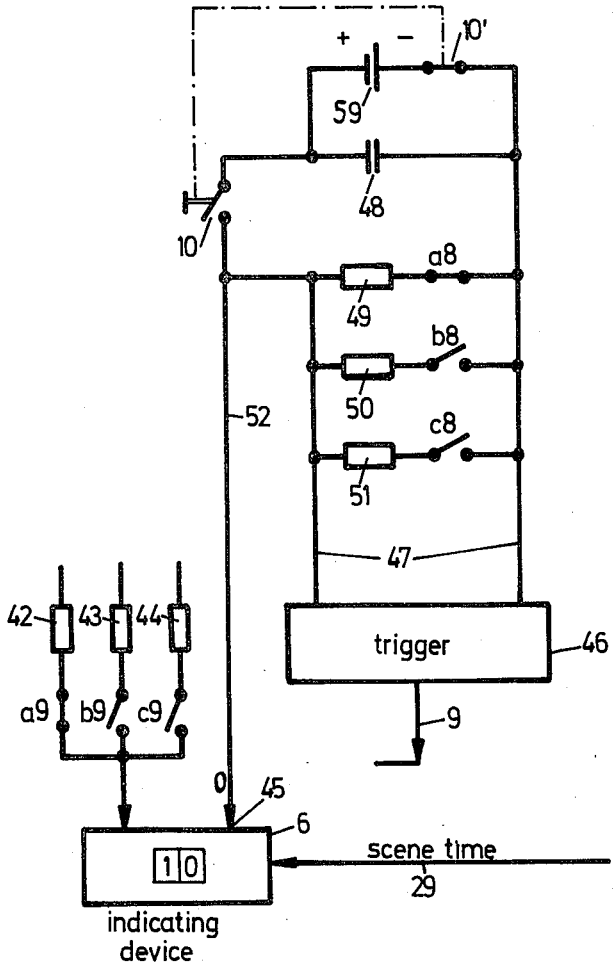
FIG. 2 shows details of the circuit connections of the device of FIG. 1.

FIG. 2 shows more clearly the structure of parts 4 and 8. It shows that the indicating device 6 is operated through contacts *a*9 to *c*9 of relays A to C through resistances 42 to 44. The contact *a*9 is closed corresponding to the closed functional key 1, and it provides through the resistance 42 the transmission of the scene time of 10 sec. provided by the key 1 to the indicating device 6. Thus, the numeral 10 appears in the indicating area of the device 6.

The scene timer switch 8 contains a trigger 46, which tips when a predetermined voltage is reached at its inlet 47 and produces a switch-off impulse in the conduit 9. The key 10 actuates a contact 10' which is closed in the illustrated position, namely, prior to the starting of a scene. Thus, a condenser 48 is charged by the current source 59, but cannot discharge. Parallel to the condenser lie three resistances 49 to 51 corresponding to the three functional keys 1 to 3; contacts *a*8 to *c*8 of the relays lie in series to them. Since the relay A is excited, the contact *a*8 is closed.

If a scene is started by actuating the key 10, then an extinguishing signal is supplied to the extinguishing inlet 45 of the indicating device 6, so that zero is shown upon it. Furthermore, the contact 10' is opened, and thus the source of current 59 is switched off from the condenser 48. Then, the condenser 48 is discharged through the key 10 and the resistance 49, as well as the closed contact *a*8. When a predetermined voltage is reached by the resistance 49 and thus at the inlet 47 of the trigger 46, it tips and transmits to the camera 39 a signal for ending the photographing scene. The duration of the scene is then determined by the measurements of the resistances 49 to 51, so that, by the size of these resistances, the duration can be adapted to the functional keys 1 to 3.

When the X-ray tube has cooled off, the signal upon the conduit 29, which has been produced in the described manner by the calculator 11, produces upon the indicating device 6 an indication that the scene duration of 10 sec. is again available corresponding to the closed contact *a*9.

I claim:

1. An X-ray diagnosing device for producing X-ray photographing series, particularly motion pictures, comprising an X-ray tube, an indicating device connected with said X-ray tube for indicating permissible scene duration and a calculator connected with its output with said indicating device and being electrically programmed corresponding to anticipated photographing programs, each program of the calculator representing the pause, required for the full scene duration after the last photographing series, for protecting the X-ray tube from overload, means for selecting the operative program of the calculator corresponding to the selected photographing program, and means for delivering a signal to the calculator according to the actual scene duration, the calculator supplying a zero output signal to the indicator during the pause determined by the selected program and a full scene duration signal after the termination of this pause.

2. An X-ray diagnosing device according to claim 1, wherein said indicating device is switchable to zero at the beginning of a scene, and wherein said calculator produces upon said indicating device a signal indicating a full scene duration after the termination of the required pause.

3. An X-ray diagnosing device according to claim 2, wherein said calculator comprises a capacitor, and means charging said capacitor corresponding to the photographing programs during the duration of a scene and discharging it after the ending of a scene.

4. An X-ray diagnosing device according to claim 3, wherein the last-mentioned means are resistances corresponding to photographing programs.

5. An X-ray diagnosing device according to claim 4, comprising a threshold member between said indicating device and said capacitor and producing during discharge of the capacitor, when a voltage corresponding to the end of a pause has been reached, an indication of the full scene duration.

* * * * *